US005630635A

United States Patent [19]

Karlsson

[11] Patent Number: 5,630,635

[45] Date of Patent: May 20, 1997

[54] ADJUSTABLE CONTAINER-HANDLING YOKE HAVING INDIVIDUALLY CROSS-BEAMS RESILIENTLY MOUNTED TO EXTENSION BEAMS

[75] Inventor: Gösta K. A. Karlsson, Killeberg, Sweden

[73] Assignee: Elmhults Konstruktions AB, Almhult, Sweden

[21] Appl. No.: 319,547

[22] Filed: Oct. 7, 1994

[51] Int. Cl.[6] ..... B66C 1/10

[52] U.S. Cl. ..... 294/81.21; 294/81.56

[58] Field of Search ..... 294/68.3, 81.1, 294/81.2, 81.21, 81.52, 81.53, 81.56

[56] References Cited

U.S. PATENT DOCUMENTS

| | | | |
|---|---|---|---|
| 3,547,478 | 12/1970 | Pradon | 294/81.21 |
| 3,713,556 | 1/1973 | Tredray | 294/81.21 |
| 3,871,697 | 3/1975 | Bechtloff | 294/81.53 |
| 4,017,110 | 4/1977 | Pease et al. | 294/81.21 |
| 4,462,627 | 7/1984 | Kudicka | 294/81.2 |
| 4,630,855 | 12/1986 | Bjurling | 294/81.21 |
| 5,052,734 | 10/1991 | Kasegawa et al. | 294/81.53 |
| 5,280,980 | 1/1994 | Coatta | 294/81.21 |

*Primary Examiner*—Dean Kramer

*Attorney, Agent, or Firm*—Cushman Darby & Cushman IP Group of Pillsbury Madison & Sutro LLP

[57] ABSTRACT

A container yoke includes four main beams which form the yoke frame, and two first extension beams which are intended to move in two of the main beams in one direction, and two second extension beams which are intended to move in the other two main beams in the opposite direction, and a first cross-beam which is carried by the two first extension beams, and a second cross-beam which is carried by the two second extension beams. The cross-beams are provided in a conventional manner with lifting hooks for gripping a container at its four corners. The respective cross-beams are attached to their two associated extension beams by a fastener in the form of an elastic coupling.

4 Claims, 5 Drawing Sheets

ADJUSTABLE CONTAINER-HANDLING YOKE HAVING INDIVIDUALLY CROSS-BEAMS RESILIENTLY MOUNTED TO EXTENSION BEAMS

BACKGROUND OF THE INVENTION

The present invention relates to a container yoke.

When handling containers or other types of rigid load-carrying receptacles of different standard dimensions there is normally used a yoke or lifting frame which includes a central frame beam and cross-beams which are mounted on the ends of the frame beam, on extension beams, and which are able to move in relation to the frame beam. The free ends of the cross-beams form the four corners of the container yoke or lifting frame and have mounted thereon downwardly depending lifting hooks which can be turned reciprocatingly through ninety degrees, with the aid of a hydraulic system for instance, thereby to engage and disengage corresponding apertures provided at the top of the four corners of the container. Because the cross-beams are able to move, the distance between the cross-beams can be altered to adjust the container yoke to engage features of and, therefore, be able to handle containers of different lengths.

The weight of the yoke, or lifting frame, together with its electric and hydraulic assembly, which functions to maneuver the extension beams and lifting hocks among other things, is quite considerable. The containers handled may be extremely heavy. With this in mind and also bearing in mind that all container yokes, or lifting frames, are handled more or less roughly, it will be understood that great demands are placed on the mechanical strength of all carrying parts, so that these parts will be able to resist the formation of cracks and other forms of fatigue. This demand is met by dimensioning all bars, beams and connections so that, wherever possible, the yoke will be sufficiently strong to withstand all uneven loads to which the container may be subjected. In the case of the earlier known technique, two extension beams together with their respective cross-beams form a welded unit which is moved into an out of the main beams between positions of 20, 40 and 45 feet in length (standard measurements). As a result of the intrinsic weight of the container yoke and the weight of the load handled, a cross-beam or extension beam will often be damaged in some way or another, requiring the beam to be replaced, despite the robust dimensions of the container yoke. Because two extension beams conventionally form a welded unit together with the cross-beams, any repair work is a time-consuming and expensive operation. Furthermore, the welded unit is difficult to manufacture, since it is imperative that the longitudinally extending extension beams be parallel with one another. This parallelism can be jeopardized by impact on one corner of the yoke, therewith rendering the yoke unserviceable.

SUMMARY OF THE INVENTION

This risk of damage to the extension beams and the cross-beams such as to render the beams unserviceable, is avoided by constructing two extension beams with associated cross-beams as three separated parts with a flexible coupling between said parts. For instance, if one corner receives a blow, the angle between extension beam and cross-beam is able to change while taking up the energy contained in the blow or impact, therewith greatly reducing the risk of crack formation, this risk being particularly great in the case of welded beams. The resultant mobility between extension beams and cross-beams enables a considerable part of the energy contained in blows and impacts to be absorbed, so that the impact forces will not propagate in the yoke and cause problems with regard to other components, such as the electrical and hydraulic assembly.

As a result of the present invention, inventorying of parts and, manufacture is simplified by virtue of the fact that extension beams and cross-beams can be replaced individually when damaged, at a much lower cost than is the case at present. For instance, the user may have an extension beam and a cross-beam in stock and therewith enable a damaged extension beam and cross-beam to be replaced and the yoke therewith made serviceable again, and then optionally repair the damaged parts. The invention thus increases the availability of a container yoke in accordance with the invention, both because the risk of damage is much smaller than in the case of known yoke constructions, and also because the idle time is drastically reduced in the case of damage to the yoke. From the aspect of manufacture, only straight beams need be manufactured—i.e extension beams and cross-beams—and parallelism with regard to the extension beams is achieved by guidance in the yoke frame and not as a result of welding extension beams and cross-beams together.

The couplings are constructed so as to enable them to be easily changed, meaning, in turn that should, for instance, a cross-beam fasten on a container in a ship's cell, the whole of the cross-beam can be removed and replaced with another, thereby enabling the yoke to be used again within the space of thirty minutes or so. In the case of present day techniques, it is necessary to go down into the cell and to release the yoke or the lifting hooks that have fastened, and then to lift the yoke from the cell and replace the lifting hooks in the yoke, whereafter handling of the container can continue. This procedure takes about two-five hours to complete.

To further complete the container yoke and to make the yoke as efficient as possible, the electrical and hydraulic assembly of the container yoke has been mounted in a separate frame structure which also accommodates the means required for maneuvering the cross-beams. This further improves the availability of the container yoke should part of the assembly responsible for maneuvering the lifting hooks or the extension beams malfunction or breakdown. The separate frame in which the power-unit is mounted in accordance with the invention is hung from and secured between the main beams which form the container yoke and which are separated from one another in pairs, and the push rods which function to move the cross-beams are connected to the extension beams so that impact forces acting on the cross-beams will not be transmitted directly to the power assembly.

BRIEF DESCRIPTION OF THE DRAWINGS

The invention will now be described in more detail with reference to an exemplifying embodiment thereof and also with reference to the accompanying drawing, in which.

DETAILED DESCRIPTION

Figure 1:
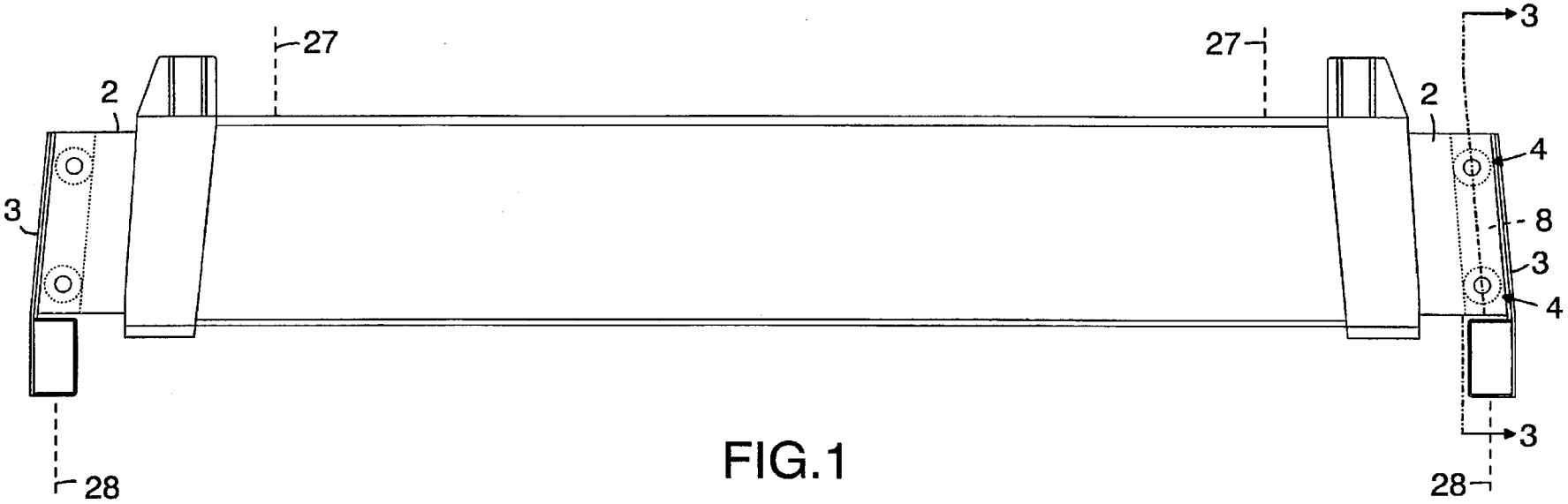
FIG. 1 is a schematic illustration of a container yoke provided in accordance with the principles of the present invention.

FIG. 1 is a schematic illustration of the container yoke, on which the yoke lifting connections and the yoke lifting hooks have been shown (except schematically as a frame suspension means at 27 and hook means at 28), these hooks being mounted at the ends of the cross-beams and depending downwards for engagement with the four corners of a container. The yoke is comprised of four main beams 1, in the form of box beams. Two extension beams 2 can be moved in the main beams 1 in one direction, whereas two other extension beams 2 can be moved in the other direction in the main beams. The free ends of extension beams 2 carry a respective cross-beam 3. Although not shown (except schematically at 28), the cross-beams are provided at their free ends with lifting hooks, so-called twist locks, which can be twisted and engaged in corresponding recesses on a container to be lifted.

Up to this point, the yoke is constructed in accordance with known technology.

According to the present invention, the cross-beams are connected to the extension beams with the aid fastening means in the form of elastic couplings or connectors 4.

Figure 2:
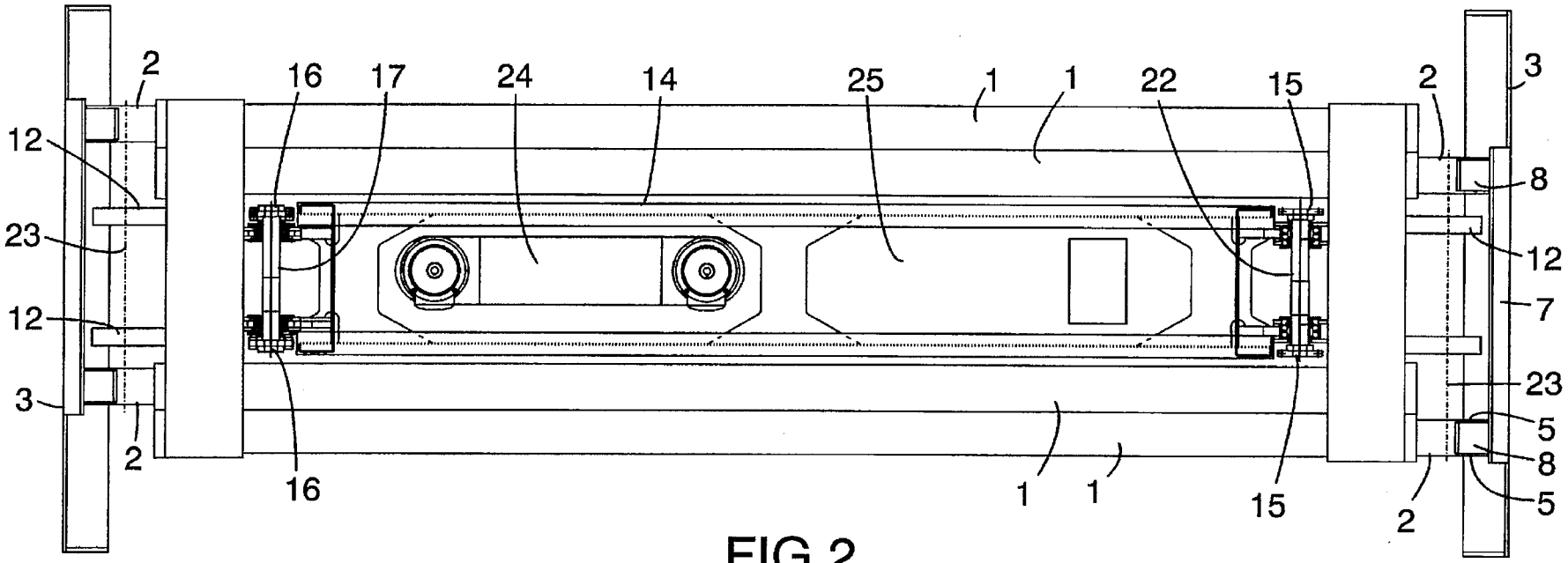
FIG. 2 illustrates the yoke schematically from above.
Figure 3:
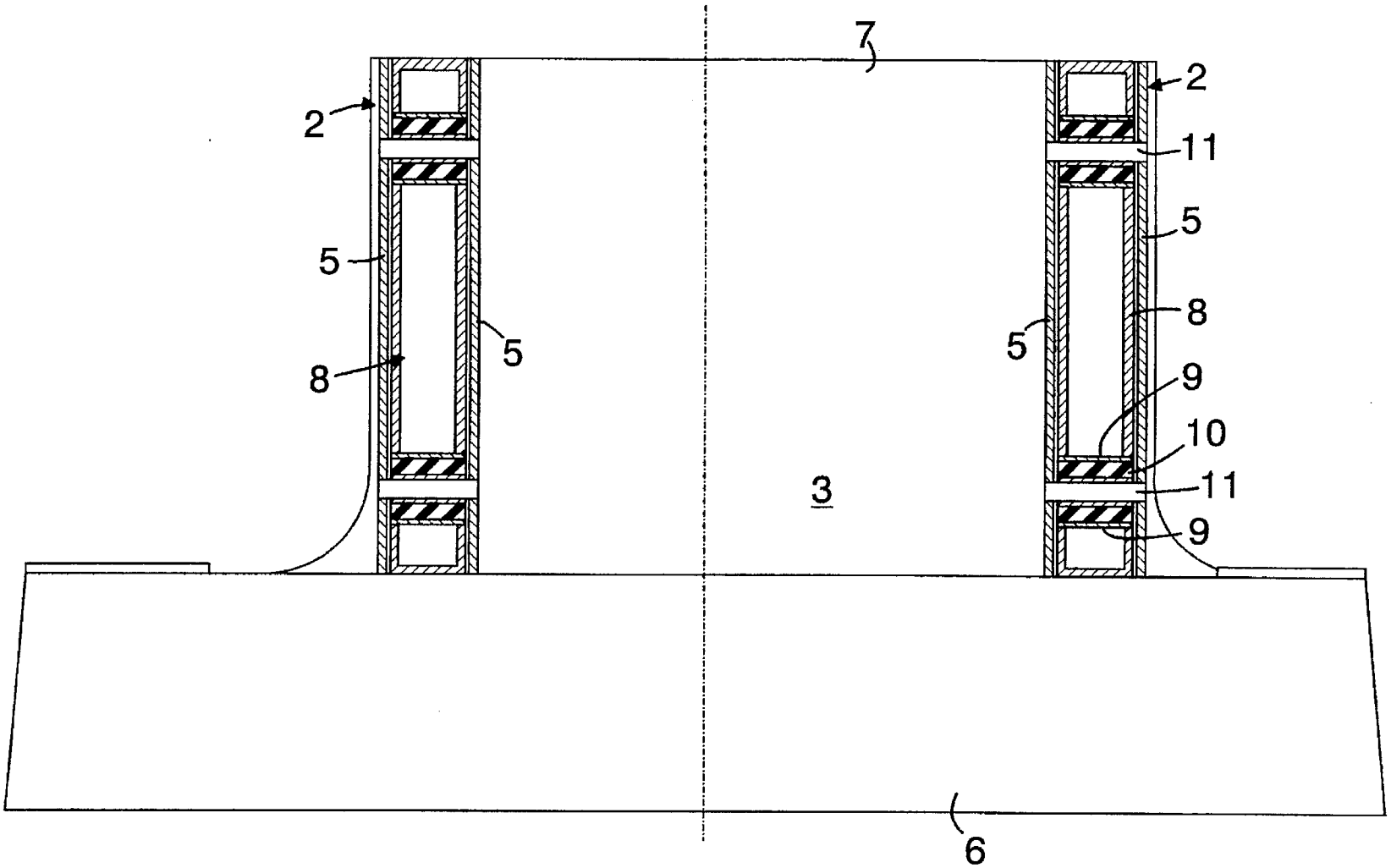
FIG. 3 is a sectional view taken on the line 3—3 in FIG. 1.

FIG. 3 is a sectional view on the line 3—3 in FIG. 1, through one part of the end-beam and through the ends of two extension beams. As will also be seen from FIG. 2, the outer ends of respective extension beams are provided with two axially directed flanges 5. As shown in FIG. 3, the cross-beam 3 includes a beam-like part 6 and a plate 7 which is upstanding from the beam-like part. Extending from the plate 7 are two projections or springs 8, which extend in between the flanges 5 of respective extension beams 2. In the case of the illustrated embodiment, respective couplings 4 include two mutually concentric sleeves 9 which contain an elastic or resilient material 10 therebetween. The elastic material 10 may be made of rubber, but is preferably made of polyurethane, this latter material exhibiting the desired qualities and properties. The material is vulcanized to the sleeves 9, for instance. As shown in FIG. 3, the outer sleeve is attached, e.g., by being welded, to the spring 8 of the cross-beam 3, whereas a bolt 11 extends through the inner sleeve 9 and passes through openings in the extension-beam flanges 5 corresponding to the bolt. The bolt 11 is secured in place with the aid of suitable means (for instance with a nut, not shown) obvious to those of normal skill in the art.

In this way, respective cross-beams are carried resiliently by the extension beams, and the cross-beams can be readily exchanged or replaced, which also applies to the extension beams.

Figure 4:
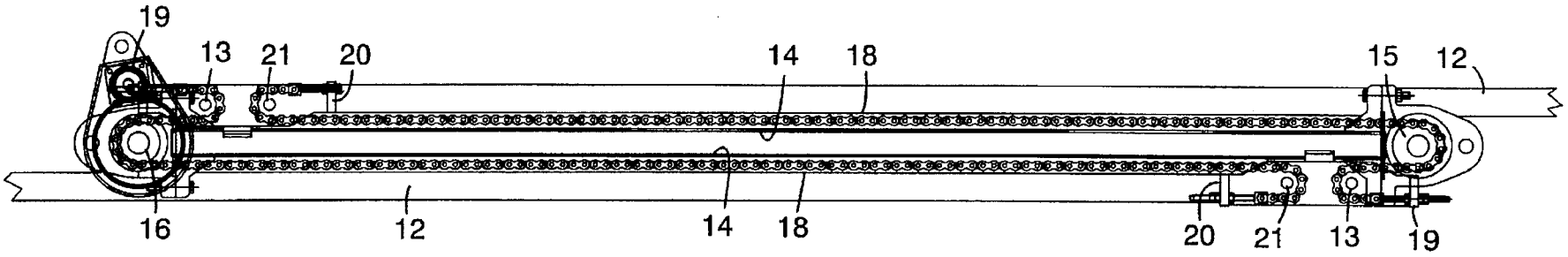
FIG. 4 illustrates schematically means for driving the extension beams and therewith also the cross-beams.

The extension beams 2 are connected pairwise to a cross-beam 3, and, in order for the container yoke to function satisfactorily, it is necessary for the extension beams to move in parallel and synchronously with one another. In order to ensure faultless reciprocating movement of the cross-beams, the beams are driven by push rods 12 which are bound synchronously with one another, see FIG. 4. For instance, two pairs of bottom push rods (12, only one is shown in FIG. 4) drive the cross-beam shown on the left in FIG. 2, whereas two top push rods 12 (only one of which is shown in FIG. 2) drive the cross-beam, which is shown to the right in the Figure. That end of respective push rods 12 which lies distal from the cross-beam 3 supports outermost one guide chain-wheel 13, whereas the frame 14, which supports the push rods and drive arrangement separately, includes two chain wheels 15 and 16. In the case of the illustrated embodiment, the chain wheel 16 is instrumental in driving the push rods 12 of one pair, which are driven synchronously in a respective direction, with an axle non-rotatably connected to a corresponding chain wheel which drives the other pair of push rods (see FIG. 2). Extending between the pair of push rods 12 are two chains 18. One end of respective chains 18 is fastened to the frame 14 (at 19) and passes over the first guide chain-wheel 13 of a push rod and back over the chain wheel 16, and from there back along the push rod 12 to its outer end, where the chain is secured (at 20). Shown in FIG. 4 is a fixed guide chain-wheel or fixed semi-circular chain-wheel ring 21, whose purpose is to improve distribution of the load on the chain at this end. The chain that coacts with the upper push rod 12 runs along a similar path, although this time over the chain wheel 15 which in this embodiment is freely rotatable on an axle 22 common with the axle of a corresponding chain wheel coacting with the second pair of push rods. If the chain wheel 16 is rotated clockwise from the position of the push rods 12 illustrated in FIG. 4, for instance by an electric or hydraulic motor, the bottom chain will be subjected to a pulling force and the bottom push rod 12 will be pushed out to the left in the Figure. This means that the guide chain-wheel 13 of this push rod will entrain the upper run of the chain to a corresponding extent, to the right in the Figure, causing the push rod 12 to move to the right together with the chain. This results in exact synchronous movement of the push rods. In order to afford maximum protection to the push rods, chains and other devices on the container yoke against the effects of impacts and blows, the respective push rods 12 are not connected directly to their associated cross-beams 3. Instead, the ends of the push rods are connected to an associated extension beam 2, as indicated in FIG. 2 in chain line 23, for instance with the aid of a bolt or a bracket fitting.

Figure 5:
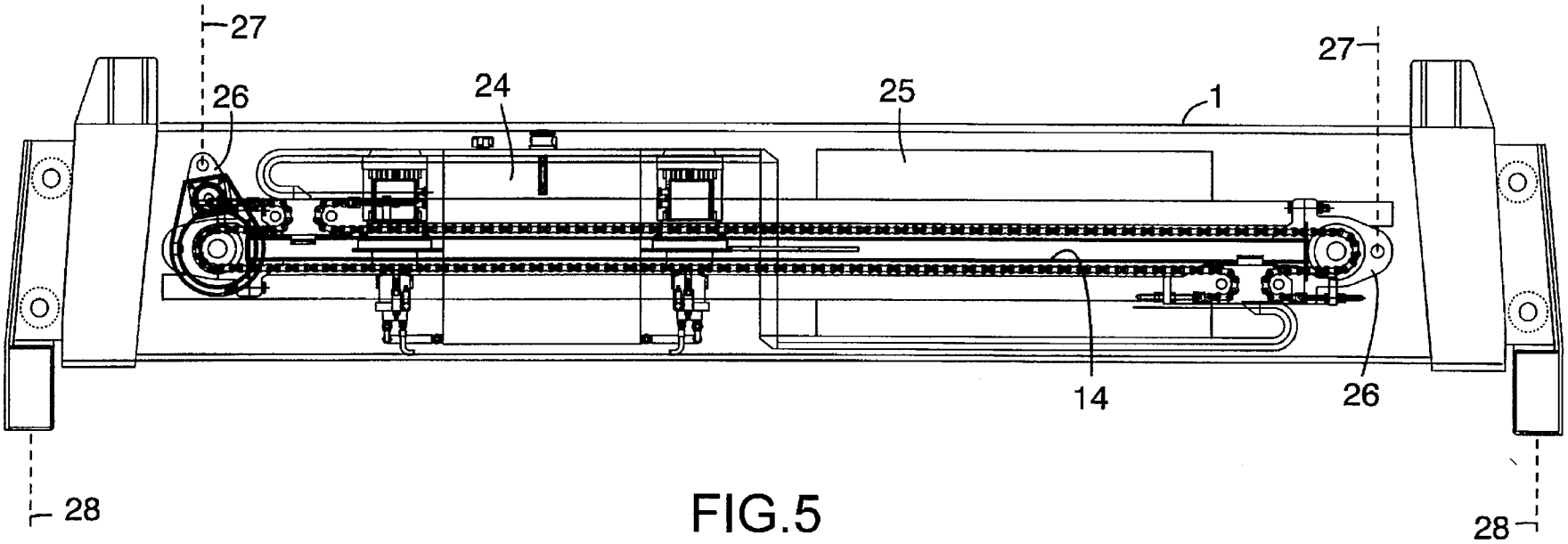
FIG. 5 is a schematic view from one side of a container-yoke carrying insert with the extension-beam and lifting-hook power units, wherein a beam pair is cut away so that the insert can be seen.

FIG. 2 principally illustrates the manner in which the separate frame 14, the push rods 12 and chains 8 are suspended between the pairs of mutually adjacent main beams 1. FIGS. 2 and 5 also show the hydraulic unit 24 and the electric unit 25 necessary for powering the container yoke, these units also being mounted on and carried by the frame 14, therewith forming a unit which can be fitted easily on the container yoke or lifting frame. This unit, or assembly, will naturally also carry an hydraulic pump and cable trains, together with gearing, etc. It will be understood that the main beam nearest the viewer of FIG. 4 has not been shown in the Figure. Neither has the actual frame suspension been shown, although its attachment to the yoke has been indicated by the perforated lugs 26.

It will be understood that the attachment devices or fastening devices between extension beams and cross-beams may have forms different from that described and illustrated, the main criterion being that the connection between extension beams and cross-beams be elastic.

I claim:

1. A container yoke, comprising:

four main beams providing a yoke frame, two first extension beams mounted in a first two of said main beams for linear movement in one direction;

two second extension beams mounted in a second two of said main beams for linear movement in another direction which is opposite to said one direction;

a first cross-beam carried by said two first extension beams and attached thereto by respective fasteners provided as respective elastic couplings;

a second cross-beam carried by said two second extension beams, and attached thereto by respective fasteners provided as respective elastic couplings; and said cross-beams being collectively provided with four lifting hooks arranged in a rectangular pattern, for releasably gripping a shipping container at four upper corners of the shipping container;

each said elastic coupling between a respective said cross-beam and the respective said extension beam including:

two flanges mounted in spaced, confronting relation on the respective extension beam;

a spring base mounted on the respective cross-beam, each said spring base having two elastic bushing assemblies extending between said two flanges; and two retainers, securing respective elastic bushing assemblies securing each said elastic bushing assembly to the respective said two flanges.

2. The container yoke of claim 1, wherein each said elastic bushing assembly includes:

two radially spaced, concentric sleeves having opposite ends; and a tubular body of elastic material radially sandwiched between said concentric sleeves;

a radially outer one of said sleeves being connected at respective ends thereof to said spring base; and each said retainer comprising a pin removably extending axially through the radially inner one of said sleeves and having opposite ends thereof secured against said flanges, for permitting disassembly of the respective said cross-beam from the respective said extension beams.

3. The container yoke of 1, further comprising:

structure acting between said cross-beams, and between each said cross-beam and said yoke frame for correspondingly moving said cross-beams equal distances in opposite directions, so that as said container yoke is adjusted to carry containers of differing length, said cross-beams remain symmetrically located on opposite sides of an imaginary centerline plane of said container yoke.

4. The container yoke of claim 3, wherein:

said structure is arranged to be mounted to and demounted as a unit from between said yoke frame and said cross-beams.

* * * * *